US008561804B2

(12) United States Patent
Carr et al.

(10) Patent No.: US 8,561,804 B2
(45) Date of Patent: Oct. 22, 2013

(54) SCREEN CLAMP

(75) Inventors: Brian S. Carr, Burlington, KY (US); Benjamin L. Holton, Dayton, KY (US); Eric Cady, Florence, KY (US)

(73) Assignee: M-I LLC, Houston, TX (US)

( * ) Notice: Subject to any disclaimer, the term of this patent is extended or adjusted under 35 U.S.C. 154(b) by 644 days.

(21) Appl. No.: 12/681,020

(22) PCT Filed: Oct. 1, 2008

(86) PCT No.: PCT/US2008/078403
§ 371 (c)(1),
(2), (4) Date: Mar. 31, 2010

(87) PCT Pub. No.: WO2009/046071
PCT Pub. Date: Apr. 9, 2009

(65) Prior Publication Data

US 2010/0236995 A1 Sep. 23, 2010

Related U.S. Application Data

(60) Provisional application No. 60/977,875, filed on Oct. 5, 2007, provisional application No. 61/034,411, filed on Mar. 6, 2008.

(51) Int. Cl.
*B07B 1/49* (2006.01)

(52) U.S. Cl.
USPC ..... 209/405

(58) Field of Classification Search
USPC ..... 209/403, 405
See application file for complete search history.

(56) References Cited

U.S. PATENT DOCUMENTS

| | | | | |
|---|---|---|---|---|
| 4,137,157 | A * | 1/1979 | Deister et al. | 209/403 |
| 5,615,776 | A * | 4/1997 | Bjorklund et al. | 209/403 |
| 6,675,975 | B1 | 1/2004 | Cook et al. | |
| 7,478,728 | B2 * | 1/2009 | Fisher et al. | 209/399 |
| 2004/0149632 | A1 * | 8/2004 | Schulte et al. | 209/405 |
| 2006/0219608 | A1 * | 10/2006 | Scott et al. | 209/406 |
| 2007/0125688 | A1 * | 6/2007 | Ballman et al. | 209/405 |
| 2008/0078697 | A1 | 4/2008 | Carr | |
| 2010/0236995 | A1 * | 9/2010 | Carr et al. | 209/365.1 |
| 2011/0036759 | A1 * | 2/2011 | Ballman | 209/255 |

FOREIGN PATENT DOCUMENTS

| | | | |
|---|---|---|---|
| DE | 25 04 069 | A1 | 8/1976 |
| EP | 0 218 315 | A2 | 4/1987 |
| GB | 406 474 | A | 3/1934 |
| WO | 2004/069374 | A | 8/2004 |

OTHER PUBLICATIONS

International Search Report from PCT/US2008/078403 datedJun. 17, 2009 (5 pages).
Written Opinion from PCT/US2008/078403 dated Jun. 17, 2009 (7 pages).
Office Action issued in corresponding Canadian Application No. 2,701,730; Dated Apr. 30, 2012 (2 pages).

(Continued)

*Primary Examiner* — Terrell Matthews
(74) *Attorney, Agent, or Firm* — Osha Liang LLP

(57) ABSTRACT

A screen clamp (400) including a track (402) configured to secure a shaker screen (420) to a shaker, the track including an angled surface configured to contact a corresponding beveled edge of the shaker screen, the screen clamp further including an upper retainer (404) configured to extend from an inner wall of the shaker over at least a portion of the shaker screen.

23 Claims, 8 Drawing Sheets

(56) References Cited

OTHER PUBLICATIONS

Office Action issued in corresponding Chinese Application No. 200880110319.2; Dated May 3, 2012 (8 pages).
Office Action issued in corresponding European Application No. 08 835 955.9; Dated Jul. 22, 2011 (6 pages).
Office Action issued in corresponding Canadian Application No. 2,701,730; Dated Jul. 25, 2011 (2 pages).
Office Action issued in corresponding Chinese Application No. 200880110319.2; Dated Apr. 1, 2013 (10 pages).
Office Action issued in corresponding Chinese Application No. 200880110319.2; Dated Jul. 24, 2013 (7 pages).

* cited by examiner

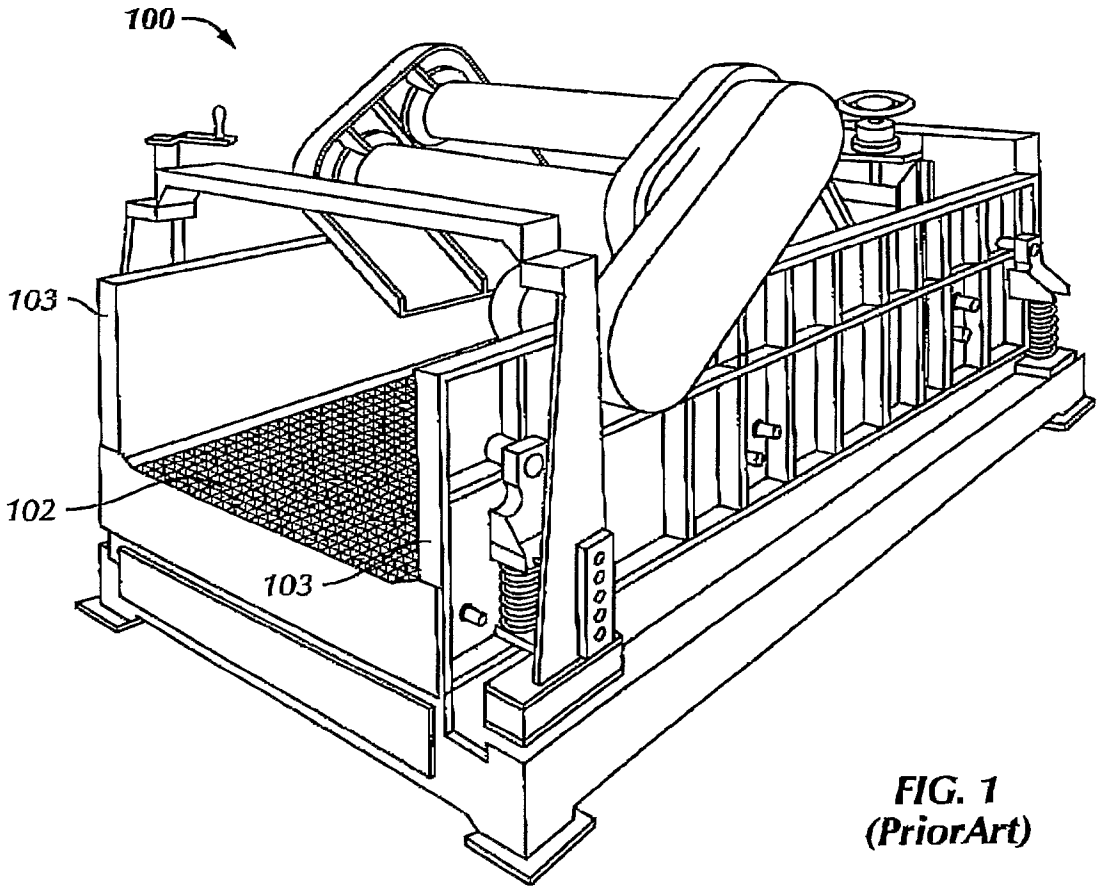
FIG. 1
(PriorArt)

SCREEN CLAMP

BACKGROUND

1. Field of the Disclosure

Embodiments disclosed herein relate generally to apparatus and methods for securing a shaker screen to a shaker. More specifically, the present disclosure relates to a screen clamp for removeably securing a shaker screen to a shaker.

2. Background Art

Oilfield drilling fluid, often called "mud," serves multiple purposes in the industry. Among its many functions, the drilling mud acts as a lubricant to cool rotary drill bits and facilitate faster cutting rates. Typically, the mud is mixed at the surface and pumped downhole at high pressure to the drill bit through a bore of the drillstring. Once the mud reaches the drill bit, it exits through various nozzles and ports where it lubricates and cools the drill bit. After exiting through the nozzles, the "spent" fluid returns to the surface through an annulus formed between the drillstring and the drilled wellbore.

Furthermore, drilling mud provides a column of hydrostatic pressure, or head, to prevent "blow out" of the well being drilled. This hydrostatic pressure offsets formation pressures, thereby preventing fluids from blowing out if pressurized deposits in the formation are breached. Two factors contributing to the hydrostatic pressure of the drilling mud column are the height (or depth) of the column (i.e., the vertical distance from the surface to the bottom of the wellbore) itself and the density (or its inverse, specific gravity) of the fluid used. Depending on the type and construction of the formation to be drilled, various weighting and lubrication agents are mixed into the drilling mud to obtain the right mixture. Typically, drilling mud weight is reported in "pounds," short for pounds per gallon. Generally, increasing the amount of weighting agent solute dissolved in the mud base will create a heavier drilling mud. Drilling mud that is too light may not protect the formation from blow outs, and drilling mud that is too heavy may over invade the formation. Therefore, much time and consideration is spent to ensure the mud mixture is optimal. Because the mud evaluation and mixture process is time consuming and expensive, drillers and service companies prefer to reclaim the returned drilling mud and recycle it for continued use.

Another significant purpose of the drilling mud is to carry the cuttings away from the drill bit at the bottom of the borehole to the surface. As a drill bit pulverizes or scrapes the rock formation at the bottom of the borehole, small pieces of solid material are left behind. The drilling fluid exiting the nozzles at the bit acts to stir-up and carry the solid particles of rock and formation to the surface within the annulus between the drillstring and the borehole. Therefore, the fluid exiting the borehole from the annulus is a slurry of formation cuttings in drilling mud. Before the mud can be recycled and repumped down through nozzles of the drill bit, the cutting particulates must be removed.

Generally, a shaker screen assembly is disposed on a screen deck of a shaker.

Over time, solids may collect or build up on a surface of the screen deck. The solids build-up may prevent the shaker screen from being properly seated and/or aligned in the shaker. Accordingly, there exists a need for a mechanism to secure a screen in a shaker that reduces the build up of solids in its tracks.

SUMMARY OF THE DISCLOSURE

In one aspect, embodiments of the present disclosure relate to a screen clamp including a track configured to secure a screen to a shaker, the track including an angled surface configured to contact a corresponding beveled edge of a shaker screen. The screen clamp further includes an upper retainer configured to extend from an inner wall of the shaker over at least a portion of the screen.

In another aspect, embodiments of the present disclosure relate to a screen clamping assembly including a screen comprising beveled edges along at least a lower perimeter, and at least two screen clamps disposed on the inside walls of the shaker, each screen clamp including tracks configured to secure the screen to a shaker, the tracks including angled surfaces configured to contact the corresponding beveled edges of the screen. The screen clamps further include an upper retainer configured to extend from an inner wall of the shaker over at least a portion of the screen.

In another aspect, embodiments of the present disclosure relate to a method to secure a shaker screen, the method including installing the shaker screen into at least two screen clamps attached to an inside wall of a shaker, wherein the installing includes aligning beveled edges of the shaker screen with angled surfaces of the screen clamps.

In yet another aspect, embodiments of the present disclosure relate to a screen clamp including a track configured to receive a shaker screen, the track including a curvilinear surface configured to contact a corresponding radiused edge of the shaker screen, and an upper retainer configured to extend from an inner wall of a shaker over at least a portion of the shaker screen.

Other aspects and advantages of the invention will be apparent from the following description and the appended claims.

BRIEF DESCRIPTION OF DRAWINGS

FIG. 1 shows a conventional shaker apparatus.

DETAILED DESCRIPTION

In one aspect, embodiments disclosed herein relate to apparatus and methods for securing a shaker screen to a shaker. In particular, the present disclosure relates to a screen clamp for a shaker screen.

Referring to FIG. 1, a vibratory shaker 100 is shown. As shown, a screen 102 is detachably secured to vibratory shaker 100. With screen 102 or a plurality of screens secured in place, a tray is formed with the opposed, parallel sidewalls 103 of shaker 100. Drilling mud, along with drill cuttings and debris, is deposited on top of screen 102 at one end. Screen 102 is vibrated at a high frequency or oscillation by a motor or motors for the purpose of screening or separating the drilling mud on screen 102. The liquid and fine particles pass through screen 102 by force of gravity and acceleration caused by the motor and are recovered underneath. Solid particles above a certain size migrate and vibrate across screen 102 where they are discharged. Screen 102 may include filtering elements attached to a screen frame (not shown). The filtering elements may further define the largest solid particle capable of passing therethrough.

Figure 2A:
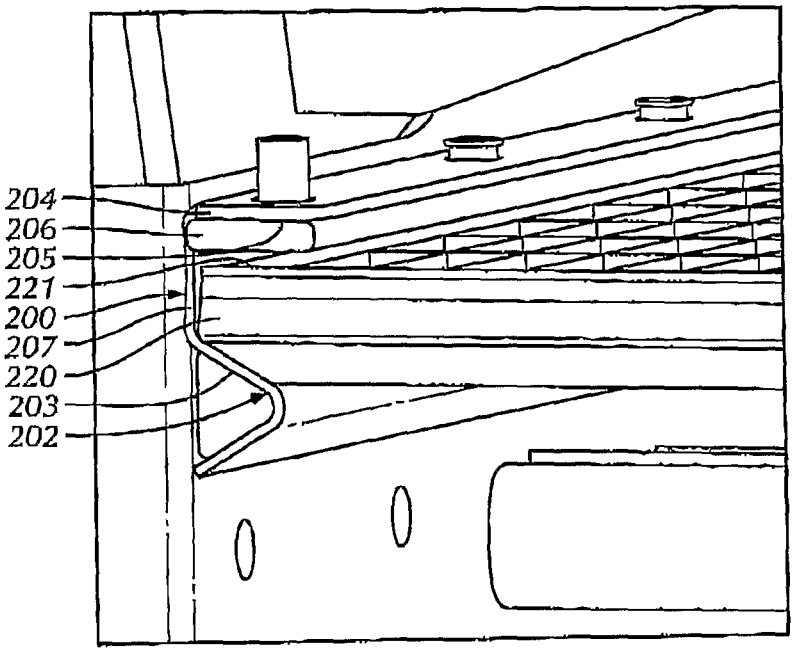
FIG. 2A shows an assembly view of a screen clamp in accordance with embodiments of the present disclosure.

Referring to FIG. 2A, a screen clamp 200 is shown in accordance with embodiments of the present disclosure. Screen clamp 200 may be attached to an inside wall of a shaker by any method known to those skilled in the art, including, for example, mechanical fasteners and/or welding. Screen clamps 200 may be used to secure a screen 220 to the shaker, wherein at least one screen clamp 200 is positioned on a side wall of the shaker. In certain embodiments, multiple screen claims 200 disposed on opposing side walls of the shaker may be used to further secure screen 220. Thus, screen 220 may be installed in the shaker by inserting screen 220 in at least two the screen clamps 200.

Generally, screen clamp 200 includes a track 202 configured to receive a shaker screen 220, wherein track 202 includes an angled surface 203 (i.e., a downward angled surface along the length of track 202). Screen clamp 200 further includes an upper retainer 204 positioned above track 202, such that, when installed, screen 220 is disposed between upper retainer 204 and track 202. In certain embodiments, upper retainer 204 and track 202 may be joined together by a vertical portion 207. In such embodiments, track 202, upper retainer 204, and vertical portion 207 may be integrally formed as a single component. Alternatively, track 202, upper retainer 204, and vertical portion 207 may be discrete components, each being independently attached to the shaker.

Shaker screen 220 includes beveled edges 222 that correspond to angled surface 203, and are configured to contact track 202 of screen clamps 200. Beveled edges 222 of shaker screen 220 may be angled about the same as track 202, or within a given tolerance such that screen 220 may be received by screen clamp 200. In certain embodiments, beveled edges 222 of shaker screen 220 may be configured at an angle slightly less than track 202, leaving a small gap at the bottom portion of the contact area. Alternatively, beveled edges 222 may have an angle greater than track 202, which would leave a small gap at the top portion of the contact area. Furthermore, beveled edges 222 of shaker screen 220 may be integrally formed as part of shaker screen 220, or in the case of shaker screens already in use, may be attached by means known to those skilled in the art.

As illustrated, beveled edges 222 may be one substantially continuous edge down the length of shaker screen 220, or may be separated into individual smaller surfaces spaced along the of shaker screen 220. Still referring to FIG. 2A, a seal 206 may be attached to upper retainer 204, such that seal 206 is located between a bottom surface 205 of upper retainer 204 and a top surface 221 of shaker screen 220. In certain embodiments, seal 206 may be an inflatable seal, elastomer seal, or other seals known to those skilled in the art. Seal 206 may be provided to prevent or reduce debris or fluid from bypassing the shaker screen 220. In some embodiments, as discussed in further detail below, seal 206 may assist in securing shaker screen 220 between upper retainer 204 and track 202.

Figure 2B:
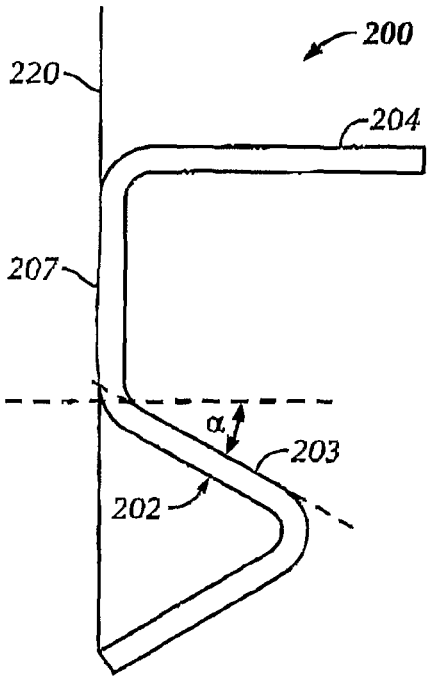
FIG. 2B shows a cross-sectional view of a screen clamp in accordance with embodiments of the present disclosure.

Referring now to FIG. 2B, a cross-sectional view of a screen clamp 200 in accordance with embodiments of the present disclosure is shown. As described above, screen clamp 200 is disposed on a shaker 220 and includes a track 202 having an angled surface 203. Screen clamp 202 further includes an upper retainer 204 and a vertical portion 207. Track 202 of screen clamp 200 is angled downward at an angle $\alpha$, and is configured to contact corresponding beveled edge (222 of FIG. 2A) of shaker screen 220 when assembled. Track 202 may be angled at varying degrees, as determined by the requirements of a certain separatory operation. In one embodiment, track 202 may include angle $\alpha$ ranging between 10° and 50°. In certain embodiments, an optimal track 202 may include angle $\alpha$ of about 30°. Accordingly, beveled edge 222 of shaker screen 220 may include an angle that corresponds to angle $\alpha$ of track 202, such that beveled edge 222 and track 202 are in substantial alignment. Thus, in one embodiment, beveled edge 222 may include an angle ranging between 10° and 50° of horizontal.

Figure 2C:
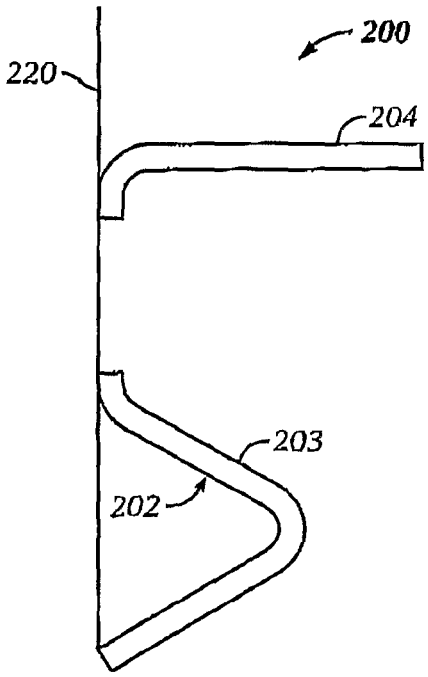
FIG. 2C shows a cross-sectional view of a screen clamp in accordance with alternate embodiments of the present disclosure.

The desired angle $\alpha$ of track 202, and thus the corresponding angle of beveled edge 222, may be determined by a number of factors, including, but not limited to, the weight of the shaker screen, shaker screen mesh size, fluid volume, solids particle size, etc. In certain embodiments, track 202 and upper retainer 204 may be separate components, as illustrated in FIG. 2C. In this embodiment, track 202 and upper retainer 204 may be attached to shaker 220 as separate components and without a vertical portion.

Track 202 may be configured to provide a seat for the installed shaker screen. In one embodiment, track 202 may be one solid surface disposed along the entire length of screen clamp 200. While track 202 is shown having a triangular cross-section, one of ordinary skill in the art will appreciate that other cross-sectional geometries are possible so long as track 202 includes an angled surface 203 with a downward slope.

Figure 2D:
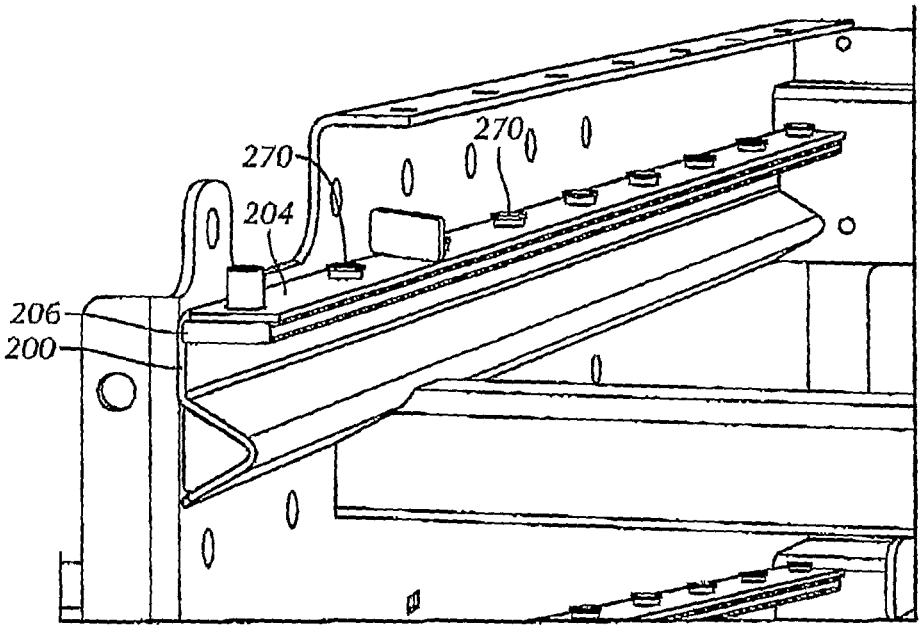
FIG. 2D shows a cross-sectional view of a screen clamp in accordance with embodiments of the present disclosure.
Figure 2E:
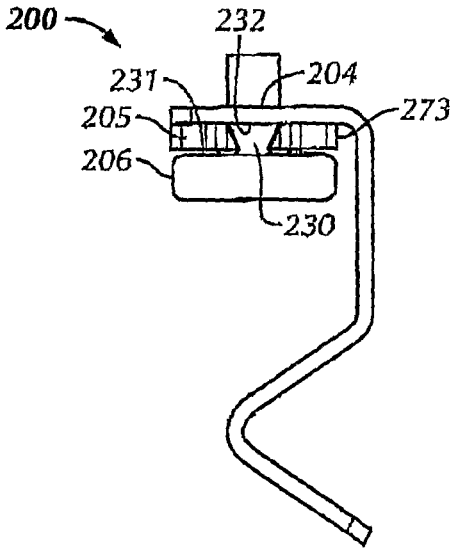
FIG. 2E shows a cross-sectional view of a screen clamp in accordance with embodiments of the present disclosure.
Figure 2F:
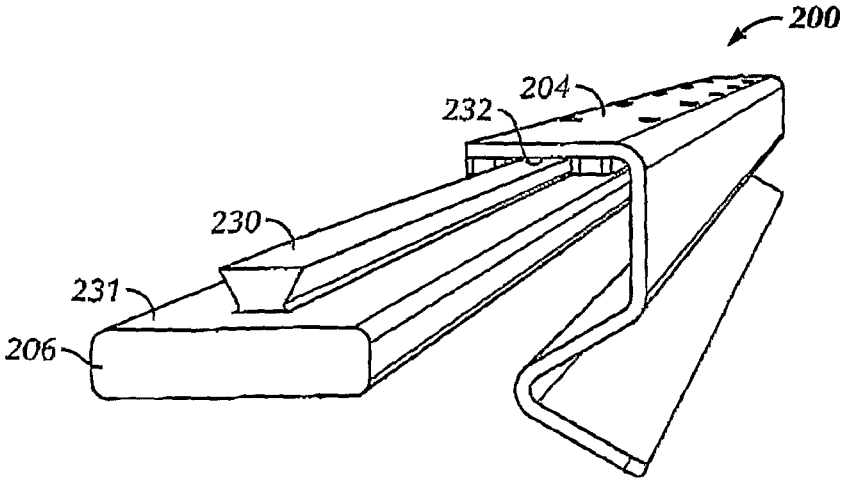
FIG. 2F shows a perspective view of the screen clamp of FIG. 2E in accordance with embodiments of the present disclosure.
Figure 2G:
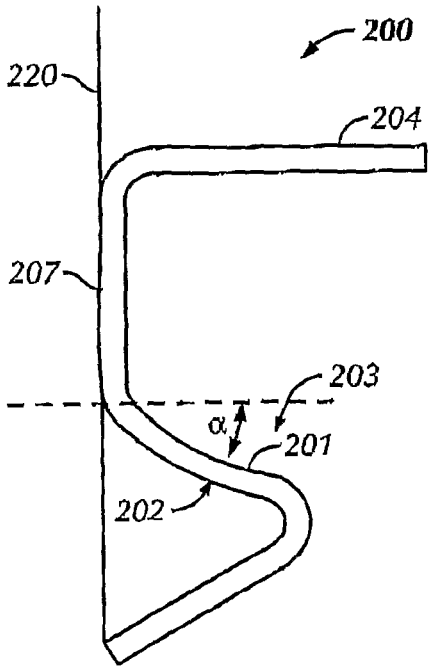
FIG. 2G shows a cross-sectional view of a screen clamp in accordance with embodiments of the present disclosure.

In certain embodiments, the angled surface 203 of track 202 may also include a curvilinear surface 201, as shown in FIG. 2G. In this embodiment, the track 202 may be angled at varying degrees, as determined by the requirements of a certain separatory operation. As discussed above, track 202 may include an angle $\alpha$ ranging between 10° and 50°. The curvilinear surface 201 of track 202 may be convex or concave, or may include a combination of straight surface sections, convex surface sections, and/or concave surface sections. A shaker screen formed in accordance with embodiments disclosed herein may include a radiused edge that corresponds to the curvilinear surface 201 of track 202. For example, in one embodiment, as shown in FIG. 4C, track 402 includes a concave curvilinear surface 201 and a shaker screen 420 of the screen clamping assembly may include a convex radiused edge 423, such that when assembled, the shaker screen 420 is aligned with track 402.

Referring generally to FIGS. 2A-2G, upper retainer 204 may be positioned above the shaker screen and configured to reduce movement of the shaker screen in an upward direction, thereby maintaining the screen in a secured position and preventing debris from bypassing the screen. In certain embodiments, upper retainer 204 may be disposed along an entire length of screen clamp 200. In other embodiments, upper retainer 204 may include protrusions spaced along the inside wall of the shaker. Exemplary protrusions may include rods disposed on an inside wall of the shaker assembly and configured to extend over at least a portion of the shaker screen. Those skilled in the art will appreciate that alternate configurations for upper retainer 204 may be used without departing from the scope of the embodiments disclosed herein.

In certain embodiments, relatively smaller screen clamps 200 may be used, such that multiple screen clamps 200 may be disposed on an inside wall of the shaker. In such an embodiment, the multiple screen clamps 200 may be spaced along the length of the shaker, so as to receive a screen and hold the screen in place during operation.

As shown in FIG. 2D, a seal 206 attached to an upper retainer 204 of the screen clamps 200 may include a plurality of push buttons 270, or toggles, that protrude through openings formed in the upper retainer 204 of screen clamps 200. The plurality of buttons 270 are configured to align and secure the seal 206 to the upper retainer 204.

In alternate embodiments, as shown in FIGS. 2E and 2F, the seal 206 may include an attachment device 230 that is configured to couple the seal 206 to the upper retainer 204. In one embodiment, the attachment device 230 may be coupled to an upper surface 231 of the seal 206 by any means known in the art, including, for example, mechanical fasteners and adhesives. Alternatively, the attachment device 230 may be integrally formed (e.g., a single mold or co-molded) with the seal 206. As shown in FIG. 2F, the attachment device 230 is disposed along a length of upper surface 231 of the seal 206. In one embodiment, the attachment device 230 extends along the entire length of seal 206. In alternate embodiments, the attachment device 230 may include one or more smaller attachment devices disposed at select locations along the length of the upper surface 231 of seal 206. Upper retainer 204 includes a corresponding groove 232 configured to receive attachment device 230, thereby coupling the seal 206 to the screen clamp 200. Corresponding groove 232 may be integrally formed with upper retainer 204 or may be formed by attaching a groove component 273 to the bottom surface 205 of the upper retainer 204. One skilled in the art will appreciate that the attachment device 230 and the corresponding groove 232 may have a dovetail profile, a bulb profile, or any other profile known in the art, such that the attachment device 230 couples the seal 206 to the upper retainer 204.

Figure 3A:
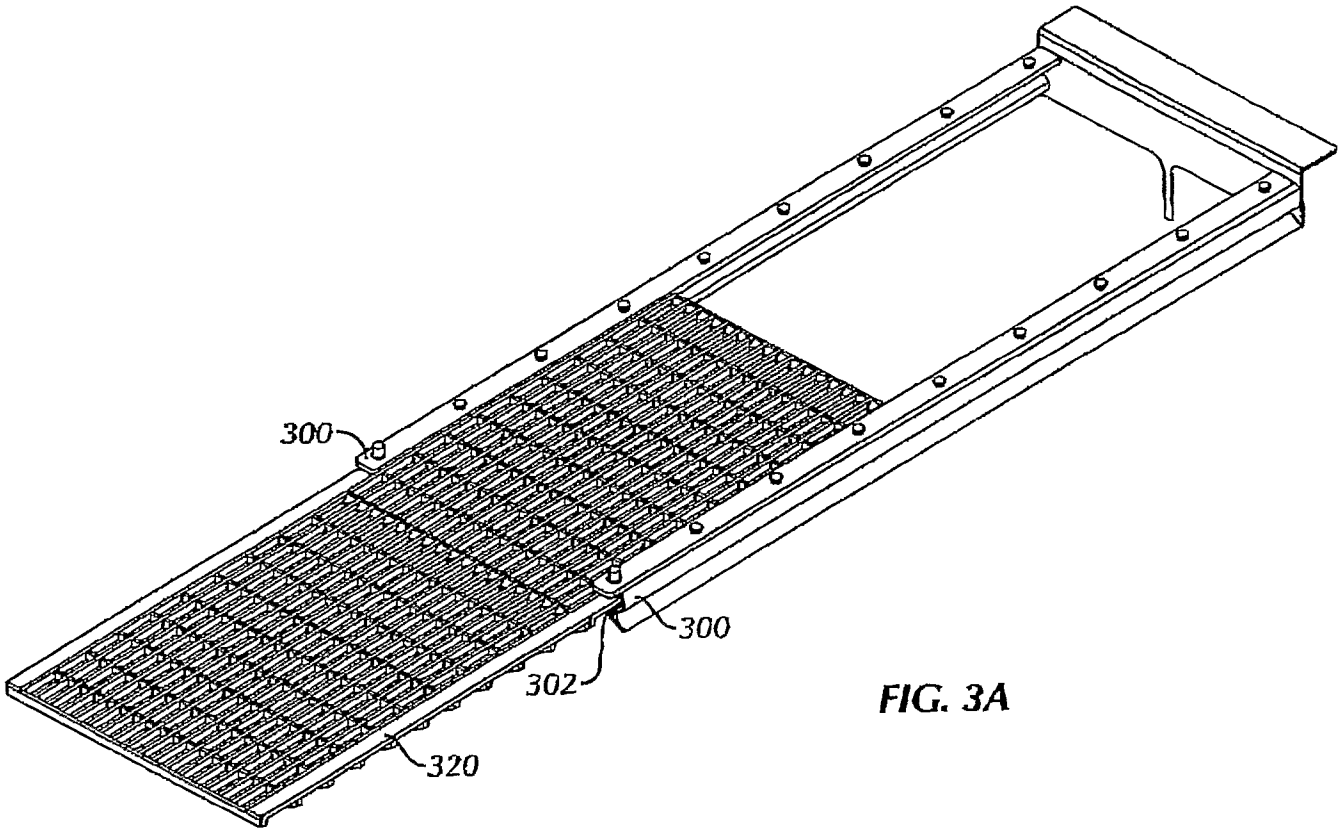
FIG. 3A shows an assembly view of an installation of a shaker screen into screen clamps in accordance with embodiments of the present disclosure.
Figure 3B:
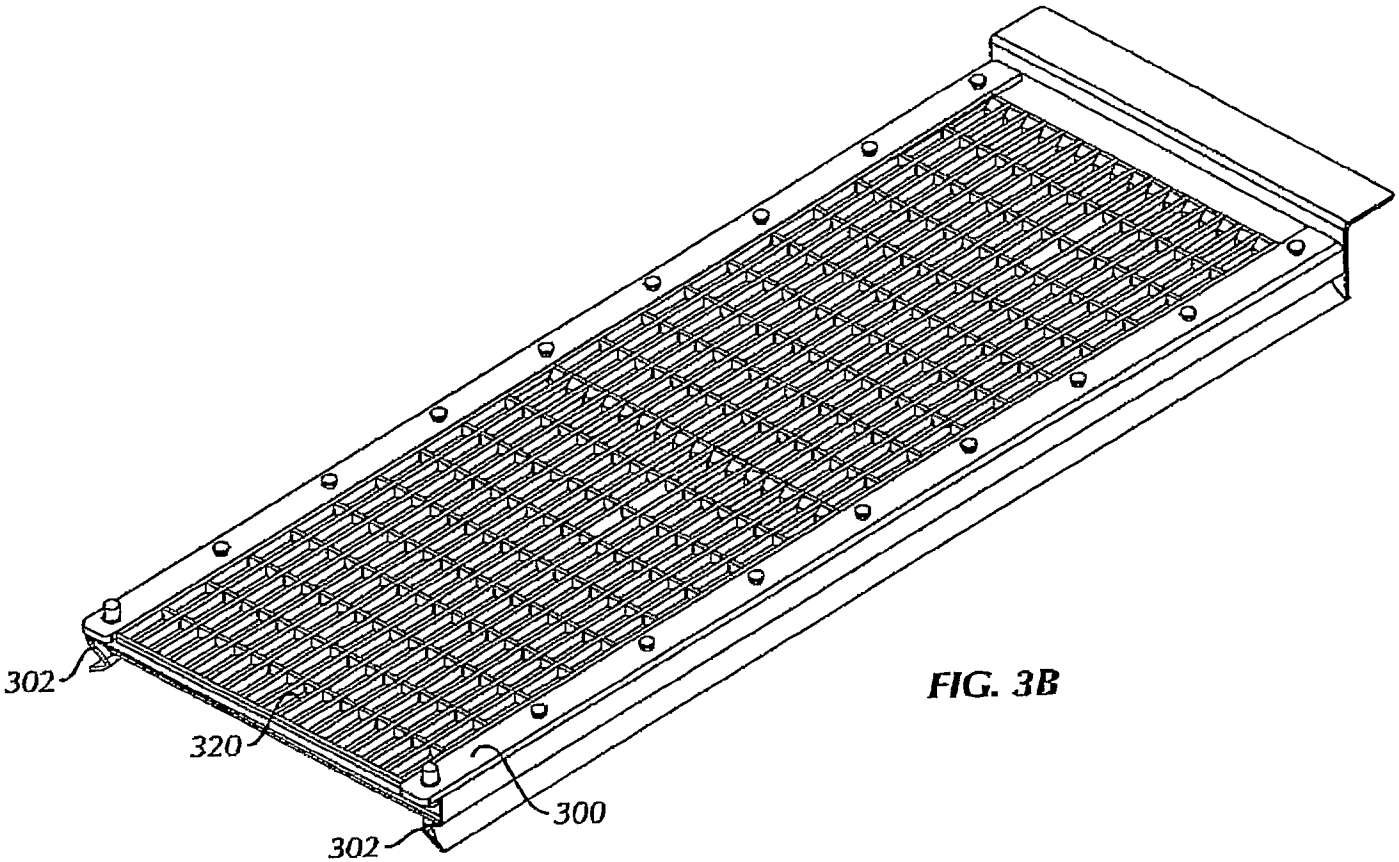
FIG. 3B shows an assembly view of a completed installation of a shaker screen into screen clamps in accordance with embodiments of the present disclosure.

Referring to FIG. 3A, an assembly view of a shaker screen 320 during installation is shown in accordance with embodiments of the present disclosure. Shaker screen 320 is inserted into screen clamps 300, such that beveled edges (not shown) of shaker screen 320 contact tracks 302 of screen clamps 300. Referring to FIG. 3B, an assembled view of shaker screen 320 is shown in accordance with embodiments of the present disclosure. When assembled, shaker screen 320 is fully inserted in screen clamps 300 and seated on tracks 302 of screen clamps 300. During installation, silicon grease, or other lubricating materials may be applied to tracks 302 or to shaker screen 320 to reduce friction and otherwise prevent binding of shaker screen 320. While FIGS. 3A and 3B show one screen 320 inserted into screen clamps 300, one of ordinary skill in the art will appreciate that more than one screen may be inserted and clamped by one or more screen clamps 300 without departing from the scope of the embodiments disclosed herein.

When the shaker is not in use, screen clamp 300 may be cleaned by removing shaker screen 320 and exposing track 302. All surfaces of track 302 may be cleaned by manual wiping, via use of a pressure sprayer, with solids removal fluids, or through other methods known to those skilled in the art. Because of the downward angled surfaces, after solids buildup on the tracks is loosened by the cleaning process, the solids may "run" down and off of track 302. In a situations when the solids are "caked on" or are otherwise hard to remove, a scraper (e.g., a wire brush) may be used to facilitate removal of the solids. Once the solids are loosened, the cleaning process as described above may be used to finish removing residual solids from tracks 302. When tracks 302 are sufficiently clean, shaker screen 320 may be re-installed and secured in screen clamps 320.

Figure 4A:
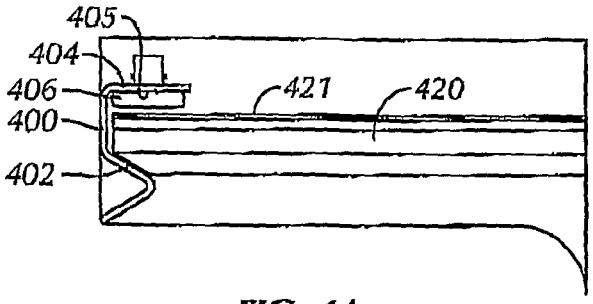
FIG. 4A shows an end view of a screen clamp before inflation of a seal assembly in accordance with embodiments of the present disclosure.
Figure 4B:
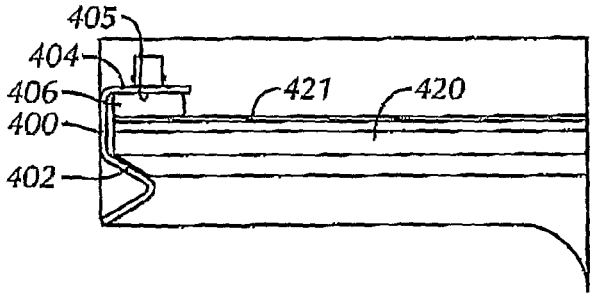
FIG. 4B shows an end view of a screen clamp after inflation of a seal assembly in accordance with embodiments of the present disclosure.
Figure 4C:
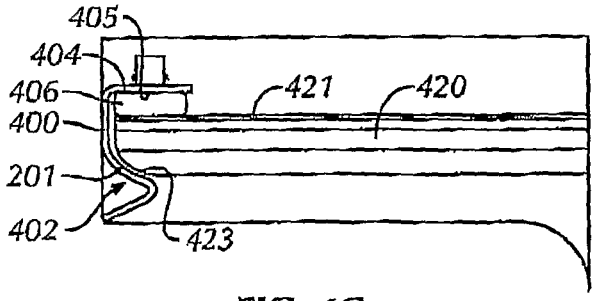
FIG. 4C shows an end view of a screen clamp after inflation of a seal assembly in accordance with embodiments of the present disclosure.

Referring to FIGS. 4A-4C together, end views of shaker screen 420 inserted into screen clamp 400 with a sealing element 406 in accordance with embodiments of the present disclosure are shown. In this embodiment, sealing element 406 is mounted on a bottom surface 405 of an upper retainer 404. Sealing element 406 may be attached to upper retainer 404 with mechanical fasteners, chemical adhesives, and/or produced through other methods known to those skilled in the art, such as co-molding sealing element 406 with upper retainer 404. In one embodiment, sealing element 406 may be disposed along at least a portion of a perimeter of bottom surface 405 of upper retainer 404. In alternate embodiments, sealing element 406 may be disposed along at least a portion of a perimeter of a top surface 421 of shaker screen 420, thereby configured to contact upper retainer 404 when screen 420 is installed.

During operation, a fluid may be injected into inflatable sealing element 406 through an inlet (not shown), thereby inflating inflatable sealing element 406 into sealing contact with top surface 421 of shaker screen 420. One of ordinary skill in the art will appreciate that the fluid may be a gas (e.g., air), a liquid, or a gel. Inflation of sealing element 406 may push shaker screen 420 downward into sealing engagement with track 402 (as specifically illustrated in FIGS. 4B and 4C). Thus, the need for typical wedge blocks and/or other screen securing mechanisms may be eliminated. Additionally, inflatable sealing element 406 may reduce or prevent leakage of unfiltered drilling fluid over the sides of the shaker screen 420. An inflatable sealing mechanism that may be used with embodiments disclosed herein is described in U.S. patent application Ser. No. 11/860,479 entitled "Composite Screen with Integral Inflatable Seal," to Brian S. Can, filed on Sep. 24, 2007, and is hereby incorporated by reference in its entirety.

One of ordinary skill in the art will appreciate that in one embodiment, sealing element 406 may include one or multiple sealing elements disposed along at least a portion of the perimeter of top or bottom surfaces 404, 405 of shaker screen 400. Furthermore, sealing element 406 may be formed from any material known in the art including, but not limited to, rubbers, plastics, thermoplastic elastomers ("TPE"), foams, polychloroprene, polypropylene, nylon, mylar, composites, and/or any combinations thereof.

Advantageously, embodiments of the present disclosure may improve alignment of screens when installed on shakers. The angled surface configuration of the track of the screen clamp may help align a screen by self-centering the screen when the inflatable sealing element pushes down on the screen. Because of the angled surfaces and the weight of the shaker screen, the screen may be positioned so as to reduce lateral movement or the "play" of the screen during operation. The fit of the screen may thus make it less susceptible to vibrations or jolts that could otherwise move it out of alignment. Further, the fit of the screen in the screen clamps may reduce fatigue in both the screen and screen clamps, allowing longer use of the shaker screen.

Additionally, the angled geometry of the interfacing surfaces of the track and the screen may prevent an accumulation of solids on the track. In some instances, solids may build-up on conventional tracks if solids or particles bypass a seal. Moreover, as opposed to typical horizontal shelf-type screen supports, the angled surfaces of the screen clamps disclosed herein may provide easier solids cleaning because of the downward slope of the angled surface. As such, solids that bypass the screen may "fall out" or slide down the angled surfaces of the tracks more easily. Build-up of solids in conventional shakers may result in screens that are not properly positioned in the tracks. Furthermore, a large build-up of solids may lead to unwanted shifting of the shaker screen, as well as leaks, lost fluids, and inefficient separatory operations. Embodiments of the present disclosure may prevent or reduce such a build-up of solids, so that the screen may be optimally located within the shaker.

Furthermore, embodiments of the present disclosure may advantageously provide features that allow components to be more easily replaced and installed during operation. Specifically, the screen clamp may provide an attachment device for installing and securing the seal to the screen clamp while only having access to an end (i.e., discharge end) of the shaker.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. A screen clamp comprising:

a track configured to slidingly receive a shaker screen, the track comprising:

an angled surface configured to contact a corresponding beveled edge of a lower surface of the shaker screen;

an upper retainer configured to extend from an inner wall of a shaker over at least a portion of a top surface of the shaker screen; and a seal mounted on a bottom surface of the upper retainer, the seal configured to contact an upper surface of the shaker screen.

2. The clamp of claim 1, further comprising an attachment device configured to couple the seal with the upper retainer.

3. The clamp of claim 2, wherein the upper retainer comprises a groove configured to receive the attachment device.

4. The clamp of claim 3, wherein the groove extends along a length of the upper retainer and the attachment device extends along a length of the seal.

5. The clamp of claim 3, wherein the groove and attachment device include a dovetail profile when assembled.

6. The clamp of claim 1, wherein an angle of the angled track surface comprises a downward slope within a range between 10° and 50° from horizontal.

7. The clamp of claim 1, wherein an angle of the angled track surface is sloped downward at about 30° degrees from horizontal.

8. The clamp of claim 1, wherein the beveled edge of the lower surface of the shaker screen comprises a range between 10° and 50° from horizontal.

9. The clamp of claim 1, wherein the beveled edge of the lower surface of the shaker screen is about 30° from horizontal.

10. The clamp of claim 1, wherein the seal comprises an inflatable seal.

11. The clamp of claim 1, wherein the track and the upper retainer are integrally formed.

12. The clamp of claim 11, wherein a vertical portion connects the track and the upper retainer.

13. A screen clamping assembly comprising:

a shaker screen comprising beveled edges along at least a lower perimeter; and at least two screen clamps disposed on an inside wall of a shaker, each screen clamp comprising:

tracks configured to slidingly receive the shaker screen, the tracks comprising:

downward angled surfaces configured to contact corresponding beveled edges of a lower surface of the shaker screen; and an upper retainer configured to extend from the inside wall of the shaker over at least a portion of a top surface of the shaker screen.

14. The screen clamping assembly of claim 13, wherein an angle of the track is configured to provide an inward normal force on the shaker screen.

15. The screen clamping assembly of claim 13, further comprising an attachment device configured to couple a seal to a lower surface of the upper retainer.

16. The screen clamping assembly of claim 13, wherein the beveled edge of the lower surface of the shaker screen comprises an angle corresponding to an angle of the downward angled track surface.

17. The screen clamping assembly of claim 15, wherein the seal is configured to seal against an upper surface of the shaker screen.

18. A method of installing a shaker screen, the method comprising:

sliding the shaker screen having at least one beveled edge on a lower surface into a screen clamp attached to an inside wall of a shaker, the screen clamp comprising:

a track comprising a downward angled surface configured to slidingly receive the shaker screen;

an upper retainer configured to extend from the inside wall of the shaker over at least a portion of a top surface of the shaker screen; and a seal disposed on a lower surface of the upper retainer; and providing a downward force on the shaker screen with the seal.

19. The method of claim 18, further comprising:

inflating the seal disposed on the upper retainer.

20. The method of claim 19, further comprising:

contacting a top surface of the shaker screen with the seal.

21. A screen clamp comprising:

a track configured to slidingly receive a shaker screen, the track comprising:

a curvilinear surface configured to contact a corresponding radiused edge of the shaker screen; and an upper retainer configured to extend from an inner wall of a shaker over at least a portion of a top surface of the shaker screen.

22. The screen clamp of claim 21, further comprising a seal disposed along a lower surface of the upper retainer, wherein the seal is configured to provide a downward force on at least a portion of the shaker screen.

23. The screen clamp of claim 22, wherein the seal and the upper retainer are coupled along an entire length of the upper retainer.

* * * * *

UNITED STATES PATENT AND TRADEMARK OFFICE

CERTIFICATE OF CORRECTION

PATENT NO. : 8,561,804 B2
APPLICATION NO. : 12/681020
DATED : October 22, 2013
INVENTOR(S) : Carr et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 717 days.

Signed and Sealed this
Seventh Day of April, 2015

Michelle K. Lee

Michelle K. Lee
*Director of the United States Patent and Trademark Office*